United States Patent [19]

Robeson

[11] 4,118,064

[45] Oct. 3, 1978

[54] COLLAPSIBLE FOLDING ROCKING CHAIR

[76] Inventor: Terrence R. Robeson, 5662 Brace, Detroit, Mich. 48228

[21] Appl. No.: 811,576

[22] Filed: Jun. 30, 1977

[51] Int. Cl.[2] ..... A47C 4/00

[52] U.S. Cl. ..... 297/18; 297/441; 297/19

[58] Field of Search ..... 297/16, 19, 24, 18, 297/441, 442, 443, 444; 403/231, 241, 282

[56] References Cited

U.S. PATENT DOCUMENTS

| | | | |
|---|---|---|---|
| 1,125,359 | 1/1915 | McDowell | 297/444 |
| 1,969,313 | 8/1934 | Meeker | 297/441 X |

FOREIGN PATENT DOCUMENTS

| | | | |
|---|---|---|---|
| 1,281,547 | 12/1961 | France | 297/441 |
| 14,195 | 7/1916 | United Kingdom | 297/411 |

*Primary Examiner*—Roy D. Frazier
*Assistant Examiner*—Peter A. Aschenbrenner
*Attorney, Agent, or Firm*—Willis Bugbee

[57] ABSTRACT

Loosely and relatively swingable within an outer three-sided rectangular frame is an inner three-sided rectangular frame, the forward lower cross member of which is connected to the upper rearward cross member of the outer frame by a flexible fabric seat member. The inner frame is loosely connected to the outer frame at their respective lower ends and also intermediate their lower and upper ends by elongated flexible connectors, such as chains, so that the inner frame can swing relatively to the outer frame with a relative rocking motion. The upper ends of the inner and outer frame side members are joined to their respective cross members by wedge-and-groove connections so as to provide separable connections therebetween. An arm rest is adjustably mounted on each side member, which passes through an elongated rectangular opening in the arm rest and locks the arm rest when in its horizontal position of use at an acute angle to its respective inclined outer frame side member.

A modification provides a foot stool involving the same construction.

2 Claims, 5 Drawing Figures

FIG. 1
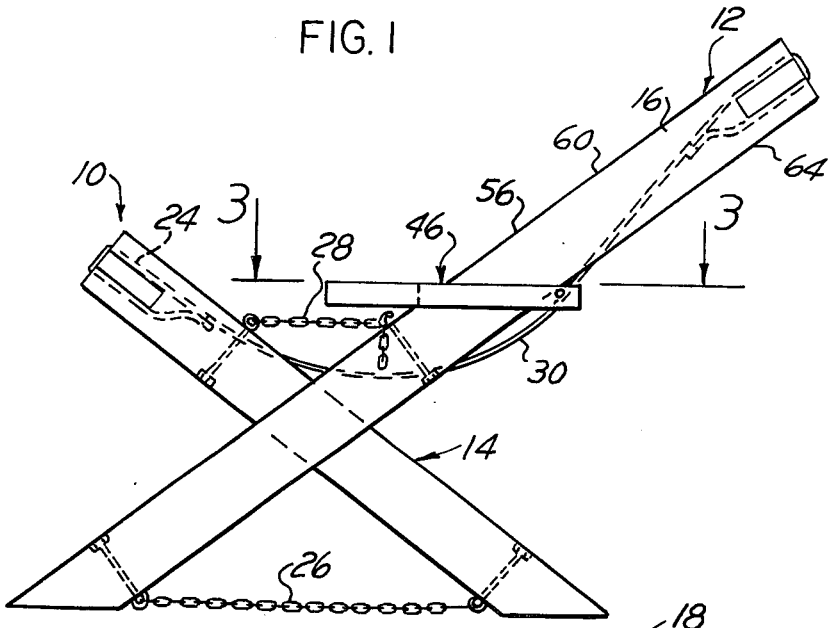
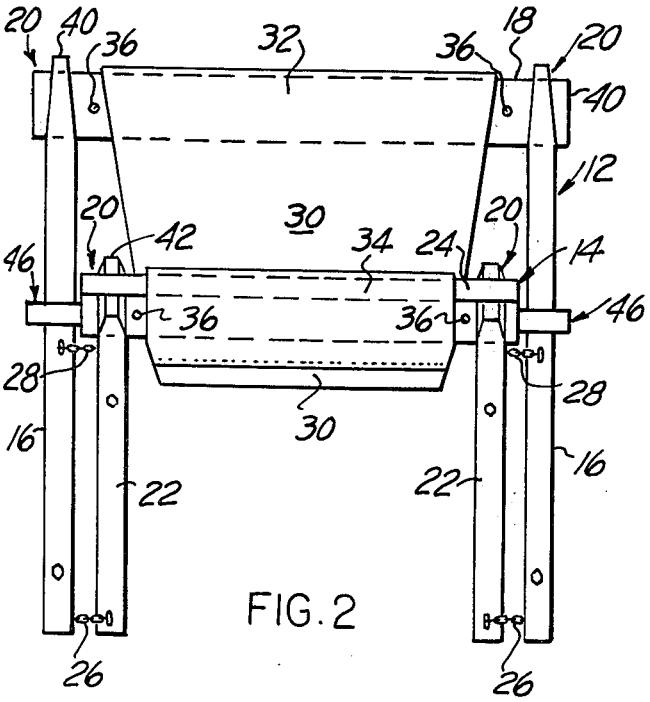
FIG. 2
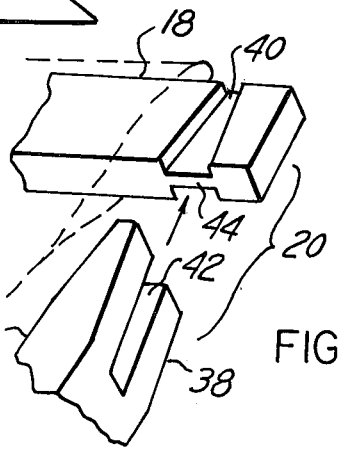
FIG. 4
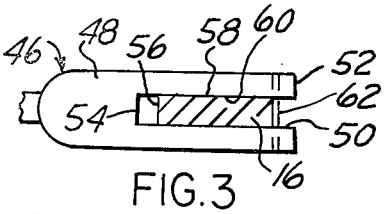
FIG. 3
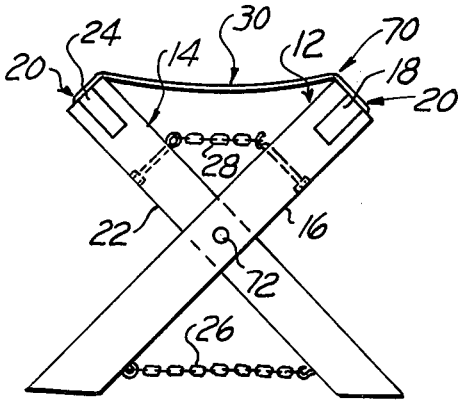
FIG. 5

COLLAPSIBLE FOLDING ROCKING CHAIR

SUMMARY OF THE INVENTION

The invention principally resides in the provision of a quickly collapsible or disassemblable and reassemblable folding rocking chair by the interfitting wedge-and-groove connections between the frame side members and cross members, also in the slidably adjustable arm rests.

In the drawing,

FIG. 1 is a side elevation of the folding rocking chair, according to one form of the present invention;

FIG. 2 is a front elevation of the folding rocking chair shown in FIG. 1;

FIG. 3 is a horizontal section partly in top plan view of the adjustable arm rest, taken along the line 3–3 in FIG. 1;

FIG. 4 is an enlarged exploded perspective view of one of the quickly separable wedge-and-groove connections between the frame side members and cross members shown in FIGS. 1 and 2, and FIG. 5 is a side elevation of a folding foot stool constructed according to the invention shown in FIGS. 1 to 4 inclusive.

Referring to the drawing in detail, FIG. 1 shows a folding rocking chair, generally designated 10, consisting generally of an outer frame 12 and an inner frame 14 swingable relatively thereto. The outer frame 12 has parallel side members 16 separably interconnected at their upper ends by a cross member 18 by means of a wedge-and-groove connection, generally designated 20 and shown in more detail in FIG. 4. The inner frame member 14 consists of shorter side members 22 separably interconnected at their forward ends by a cross member 24 by means of a similar wedge-and-groove connection 20. The lower ends of the outer and inner side members 16 and 22 are interconnected by elongated lower flexible connectors, such as chains 26, whereas the inner side members 22 are similarly interconnected by elongated upper flecible connectors, such as chains 28, the rearward ends of which, however, are secured to the outer side members 16 at points about halfway between their upper and lower ends. The cross members 18 and 24 are interconnected by a flexible fabric seat member 30, preferably of canvas, the upper and lower ends of which are looped over their respective cross members 18 and 24 at 32 and 34 respectively and sewed back upon the member 30. Snap fasteners 36 are optionally provided for holding cushions (not shown).

The wedge-and-groove connections 20 shown in the upper corners of FIGS. 1, 2 and 5 and in enlarged exploded perspective in FIG. 4 consists of tapering bifrucated wedge portions 38 at the upper ends of the frame side members 16 and 22 fitting into spaced tapered truncated V-shaped grooves 40 in the outer ends of the cross members 18 and 24. Wedge portions 38 are additionally provided with central slots 42 which fit over and partway around the partition wall 44 between the grooves 40. The adjustable arm rests 46, shown in FIGS. 1, 2 and 3, consist of slotted arm boards 48 having slots 50 open at their rearward ends 52 and extending forward therefrom so as to embrace the frame side members 16 upon which they are adjustably slidable upward and downward. The forward surface 54 of the slot 50 engages the forward surface 56 while its opposite side surfaces slidably engage the opposite side surfaces 60 of the side members 16. A cross rod 62 extends across the open rearward end of the slot 50 and engages the rearward surface 64 of its respective outer frame side member 16.

The foot stool, generally designated 70, shown in FIG. 5 is of generally similar construction to the folding rocking chair 10 of FIGS. 1 to 4 inclusive, and has similar wedge-and-groove connections 20 between the upper ends of its outer and inner side members 16 and 22 of its outer and inner frames 12 and 14, and these are similarly connected by a seat member of flexible fabric, such as canvas, generally designated 30, similarly secured to its cross members 18 and 24. Elongated flexible connectors, such as lower and upper chains 26 and 28, similarly interconnect the side members 16 and 22 of the outer and inner frames 12 and 14. However, since rocking is ordinarily not desired in a foot stool, the frame side members 16 and 22 are interconnected at their crossing points by pivot fasteners 72 which extend therethrough and consequently prevent such rocking.

In the operation of the folding rocking chair shown in FIGS. 1 to 4 inclusive, let it be assumed that the rocking chair has been assembled in the manner shown therein and that it is desired to take it apart for packing, sgorage or transportation. To do so, the operator swings the outer and inner frames upward toward one another, removes the fabric seat member 30 by separating its snap fasteners 36 and then lifts the cross members 18 and 24 to pull them away from their respective side members 16 and 22, thereby withdrawing and thus separating the wedge portions 38 from their respective truncated triangular grooves 40, at the same time withdrawing the partition walls 44 from the central slots 42 (FIG. 4). The side members 16 and 22 may then be laid alongside one another in approximate parallel relationship, with the cross members 18 and 24 then laid beside them. This assembly is then conveniently rolled up in the flexible fabric seat member 30, while the now relaxed chains 26 and 28 adjust themselves to the disassembly procedure. Disassembly of the foot stool 70 of FIG. 5 follows the same procedure with the exception of the fact that an additional step is necessary in removing the fasteners 72 from the midpoints of the frame side members 16 and 22 if it is desired to do so. If, however, it is desired merely to fold the foot stool rather than diassemble it, the fasteners 72 are left in place and serve as coaxial pivots around which the outer and inner frames 12 and 14 thereof are swung into approximately the same plane.

To reassemble the rocking chair 10 or the foot stool 70, the above-described procedure is reversed. To adjust either of the arm rests 46 upward or downward along its respective outer frame side member 16, the user lifts the forward end thereof to widen the acute angle between the slotted boards 48 into a position more nearly at right angles thereto. He then slides the arm rest 46 upward or downward as desired, then releases it, whereupon it resumes its acute-angled position held in place at its adjusted location by gripping its respective frame side member 16 between the surface 54 and the cross rod 62.

I claim:

1. A disassemblable folding seat, comprising a three-sided rearwardly-inclined outer frame including spaced parallel outer side members and an outer cross member engaging said outer side members near the upper ends thereof, a three-sided forwardly-inclined inner frame disposed within said outer frame and including spaced parallel inner side members and an inner cross member engaging said inner side members near the upper ends thereof, a rectangular seat member of flexible sheet material having a forward end secured to said inner cross member and having a rearward end secured to said outer cross member, elongated lower flexible connectors interconnecting the lower end portions of said outer and inner side members, elongated upper flexible connectors interconnecting said outer and inner side members above and remote from said elongated lower flexible connectors, and separable interfitting means joining said cross members to their respective outer and inner side members, said side members having wedge-shaped upper end portions and said cross members having end portions containing tapered grooves slidably and releasably receiving said upper end portions in mating engagement therewith, each of said wedge-shaped upper end portions having a transverse slot therethrough, and each of said cross member end portions having a pair of said tapered grooves disposed in spaced parallel relationship with a tapered wall therebetween receivable within said transverse slot.

2. A disassemblable folding seat, comprising a three-sided rearwardly-inclined outer frame including spaced parallel outer side members and an outer cross member engaging said outer side members near the upper ends thereof, a three-sided forwardly-inclined inner frame disposed within said outer frame and including spaced parallel inner side members and an inner cross member engaging said inner side members near the upper ends thereof, a rectangular seat member of flexible sheet material having a forward end secured to said inner cross member and having a rearward end secured to said outer cross member, elongated lower flexible connectors interconnecting the lower end portions of said outer and inner side members, elongated upper flexible connectors interconnecting said outer and inner side members above and remote from said elongated lower flexible connectors, and separable interfitting means joining said cross members to their respective outer and inner side members, each of said outer side members having an arm rest containing a slot in the rearward portion thereof slidably engaging its respective outer side member and also containing a transverse locking element closing the rearward end of said slot and responsive to the lowering of the forward end of said arm rest for moving into binding engagement with its respective outer side member.

* * * * *